US005295539A

United States Patent [19]

Jennings, Jr. et al.

[11] Patent Number: 5,295,539

[45] Date of Patent: Mar. 22, 1994

[54] TWO WELL HYDROCARBON PRODUCING METHOD USING MULTIPLE FRACTURES

[75] Inventors: Alfred R. Jennings, Jr., Plano; Malcolm K. Strubhar, Irving, both of Tex.

[73] Assignee: Mobil Oil Corporation, Fairfax, Va.

[21] Appl. No.: 946,217

[22] Filed: Sep. 17, 1992

[51] Int. Cl.[5] ..... E21B 43/26

[52] U.S. Cl. ..... 166/263; 166/297; 166/308

[58] Field of Search ..... 166/263, 271, 297, 308

[56] References Cited

U.S. PATENT DOCUMENTS

| | | | |
|---|---|---|---|
| 2,952,449 | 9/1960 | Bays | 166/271 X |
| 2,966,346 | 12/1960 | Huitt et al. | 166/308 |
| 3,547,198 | 12/1970 | Slusser | 166/284 |
| 3,709,295 | 1/1973 | Braunlich, Jr. et al. | 166/271 X |
| 3,990,514 | 11/1976 | Kreinin et al. | 166/271 |
| 4,005,750 | 2/1977 | Shuck | 166/308 |
| 4,067,389 | 1/1978 | Savins | 166/246 |
| 4,718,490 | 1/1988 | Uhri | 166/281 |
| 4,724,905 | 2/1988 | Uhri | 166/250 |
| 4,830,106 | 5/1989 | Uhri | 166/308 X |

*Primary Examiner*—George A. Suchfield
*Attorney, Agent, or Firm*—Alexander J. McKillop; Henry L. Ehrlich, Jr.; George W. Hager, Jr.

[57] ABSTRACT

This specification discloses a method of hydraulic fracturing a subterranean formation wherein two horizontally spaced-apart wells are provided and completed to communicate with the formation. Hydraulic fluid pressure is sequentially applied to create and propagate vertical fractures into the formation and to create a vertical fracture that communicates both wells.

10 Claims, 1 Drawing Sheet

TWO WELL HYDROCARBON PRODUCING METHOD USING MULTIPLE FRACTURES

FIELD OF THE INVENTION

This invention relates to an enhanced method of sequentially hydraulic fracturing a subsurface earth formation. This invention further relates to a method of producing hydrocarbons from a subsurface hydrocarbon-bearing formation.

BACKGROUND OF THE INVENTION

This invention is concerned with an enhanced method of sequentially hydraulic fracturing a subsurface formation. This invention is also concerned with a method of producing hydrocarbons from a hydrocarbon-bearing formation that has been fractured by using an enhanced sequential hydraulic fracturing method.

Hydraulic fracturing techniques have been widely used for stimulating wells penetrating subsurface or subterranean hydrocarbon-bearing formations by creating fractures which extend from the wells into the formation. These techniques normally involve injecting a fracturing fluid down a well and into contact with the subterranean formation to be fractured. A sufficiently high pressure is applied to the fracturing fluid to initiate a fracture in the formation and the fracturing fluid is injected down the well at a sufficiently high rate to propagate the fracture thereinto. Propping materials are normally entrained in the fracturing fluid and are deposited in the fracture to maintain the fracture open.

In U.S. Pat. No. 4,067,389 there is described a technique of hydraulically fracturing a subterranean formation wherein there is used a fracturing fluid comprised of an aqueous solution of an interaction product of a polysaccharide and a galactomannan.

In U.S. Pat. No. 3,547,198 there is described a method of forming two vertically disposed fractures communicating with a well equipped with a casing and which well penetrates a subterranean earth formation having a known preferred fracture orientation.

In U.S. Pat. No. 4,724,905 there is described a process for sequentially hydraulic fracturing a hydrocarbon-bearing formation penetrated by two closely spaced wells. In sequential hydraulic fracturing, the direction that a hydraulic fracture will propagate is controlled by altering the local in-situ stress distribution in the vicinity of a first wellbore. By this method, a hydraulic fracturing operation is conducted at the first wellbore wherein hydraulic pressure is applied to the formation sufficient to cause a hydraulic fracture to form perpendicular to the least principal in-situ stress.

While maintaining pressure in this first hydraulic fracture, a second hydraulic fracture is initiated in a second wellbore. This second hydraulic fracture, due to the alteration of the local in-situ stresses by the first hydraulic fracture, will initiate at an angle, possibly perpendicular, to the first hydraulic fracture.

SUMMARY OF THE INVENTION

This invention is directed to fracturing a subterranean formation. A first well and a second well are extended from the earth surface and are completed to communicate with the formation. Hydraulic fluid pressure is applied via the first well to the subterranean formation in an amount sufficient to initiate and propagate a first vertical fracture into the subterranean formation and thereafter the fluid pressure is reduced to, and maintained at, a pressure slightly less than the pressure necessary to propagate the vertical fracture into the formation. Hydraulic fluid pressure is applied in the second well in an amount sufficient to initiate and propagate a second vertical fracture into the formation from the second well in a direction away from and transverse to the first fracture. The first well is thereafter shut-in and the fluid pressure therein is allowed to lessen while fluid pressure is continued to be applied in the second well in a sufficient amount to initiate and propagate a third fracture from the second well that communicates with the first well.

DESCRIPTION OF THE PREFERRED EMBODIMENTS

This invention is directed to a technique of hydraulic fracturing a subterranean or subsurface formation. This invention is also directed to a technique of producing hydrocarbons from a hydrocarbon-bearing formation that has been hydraulically fractured in accordance with this invention.

In U.S. Pat. No 4,724,905 to Uhri there is described a process for sequential hydraulic fracturing a hydrocarbon fluid-bearing formation. The techniques of Uhri are applicable to the present invention, though the present invention requires certain variations and modifications to Uhri in order to accomplish the purposes and benefits of the invention.

In accordance with this invention a subterranean formation which may be a hydrocarbon-bearing formation is hydraulically fractured by utilizing a modified sequential hydraulic fracturing technique. Known hydraulic fracturing fluids that are comprised of liquids may be used in this invention. Examples of such fracturing fluids are water, crude oil, diesel oil, and acids. These fluids may be used in basic form or in combination with chemical gelling agents such as guar gums, derivatized guars, synthesized agents such as carboxymethyl cellulose, organic esters and fatty acids, as examples. In addition, heavy metal salts including borates, zirconates, chromates and aluminates may be added to complex or cross-link these gels to further enhance viscosity. These and many others known to those skilled in the art, including emulsified and foamed variations, may be used for sequential fracturing.

Preferred fracturing fluids for use in carrying out this invention are those systems which generate the maximum net fracturing pressure (pressure in the fracture above minimum stress) such as cross-linked guars and derivatized guars, cross-linked synthesized cellulose systems such as carboxymethyl cellulose and carboxymethylhydroxyethyl cellulose, and oil-water emulsion systems.

Figure 1:
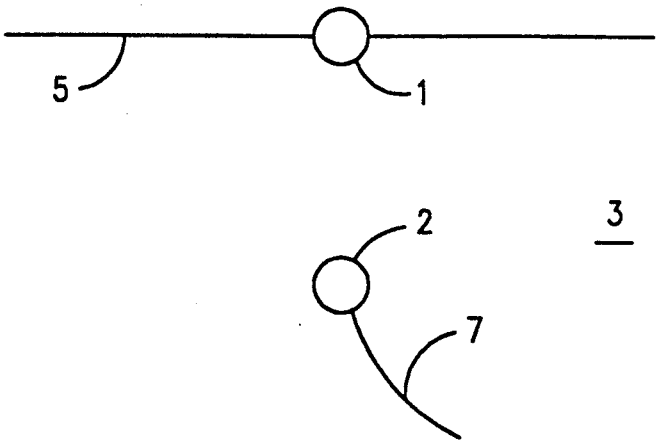
FIG. 1 illustrates an embodiment of this invention involving sequential hydraulic fracturing treatment conducted in Wells 1 and 2.

For a more detailed description of this invention reference is made to FIG. 1 wherein there is shown a plan view of the earth surface 3. A first well 1 and a second well 2 spaced horizontally apart from well 1 are provided by drilling and completing in a conventional manner to extend from the earth surface 3 to penetrate and communicate with a subterranean formation of interest, not shown. Hydrocarbonbearing formations are often times such formations of interest. Hydraulic fluid pressure is applied in said first well 1 in an amount sufficient to initiate and propagate a first vertical fracture 5 that propagates essentially in a direction perpendicular to the direction of the least principal in-situ stress of the formation. The pressure in the first well 1 is thereafter maintained or allowed to reduce slightly by natural means such as leak-off. While maintaining this pressure in well number 1, but limiting further propagation of fracture 5, hydraulic fluid pressure is thereafter applied in the second well 2 in an amount sufficient to initiate and propagate a second vertical fracture 7 into the formation from the second well 2 in a direction away from and transverse to the first vertical fracture 5.

Figure 2:
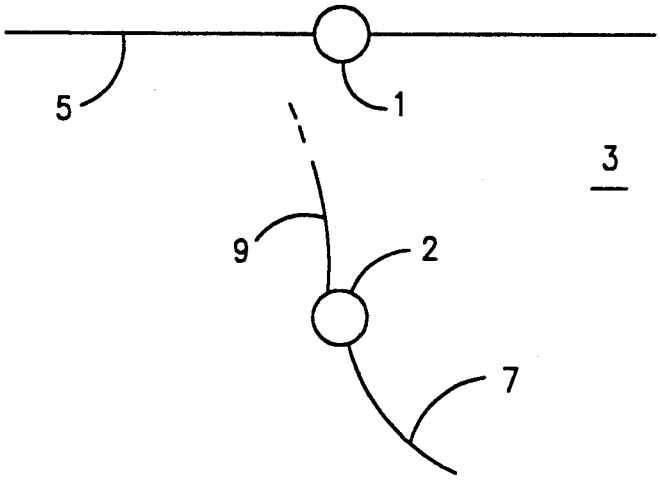
FIG. 2 illustrates a further embodiment of this invention involving forming a fracture that communicates between Well 1 and Well 2.

With reference now to FIG. 2 the first well 1 is thereafter shut-in and the fluid pressure therein is allowed to lessen. Hydraulic fluid pressure is applied in the second well 2, while the first well 1 is shut-in, in an amount sufficient to initiate and propagate a third vertical fracture 9 from the second well 2 to communicate with the first well 1 or in the alternative to communicate with the first vertical fracture 5 and thus with the first well 1. After communication is established between well 1 and well 2 the wells 1 and 2 are shut-in to allow the in-situ stresses in the formation to equilibrate. This shut-in time period may be in the order of twenty-four hours. When gelled fracturing fluids such as cross-linked hydroxypropyl guar and carboxymethyl cellulose are used, this shut-in period of twenty-four hours will also allow the fracturing fluids to hydrolyze and thus be more readily producible from the formation. After the shut-in time period fluids in the formation are allowed to flow through the fractures to wells 1 and 2 and the fracturing fluid is thus flowed back into the wells and the fractures and wells thereby are cleaned up.

Figure 3:
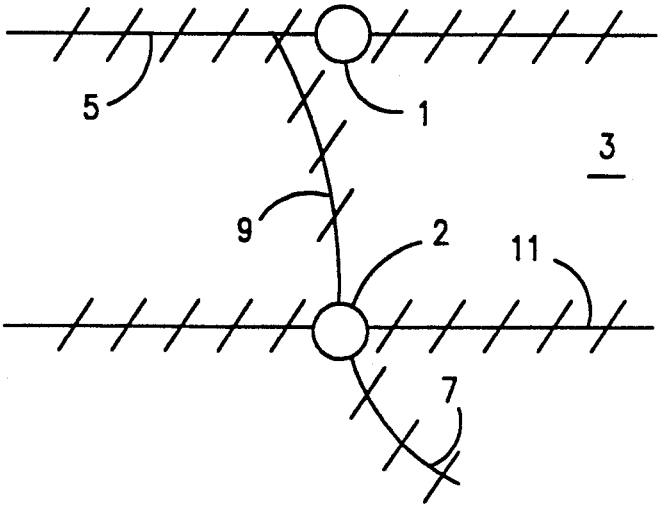
FIG. 3 illustrates other embodiments of this invention.

With reference now to FIG. 3, well 1 is shut-in and hydraulic fluid pressure is applied via well 2 to the formation in an amount sufficient to initiate and propagate into the formation a vertical fracture 11. Inasmuch as the pressure in the formation has been allowed to equilibrate the vertical fracture 11 propagates into the formation essentially parallel to the vertical fracture 5.

It should be noted, though it is apparent from the description above, that the illustration of the fractures in FIGS. 1, 2, and 3 are traces of the fractures on the plan views. As noted above, the formation into which the wells are completed to communicate with are not shown.

Also as noted above the subterranean formation being fractured is oftentimes if not usually a hydrocarbonbearing formation.

This invention is further directed to the creation of an enhanced fracture drainage pattern in a hydrocarbonbearing formation and producing hydrocarbons from the formation via a single producing well. A fracture pattern is formed in a hydrocarbon-bearing formation utilizing the technique described above. Thereafter and with reference to FIG. 3 well 1 is shut-in and well 2 is utilized as a producing well to produce hydrocarbons from the formation via the enhanced drainage pattern formed by the fracture pattern and as there illustrated. Alternative producing options include shutting-in well number 2 and producing from well number 1 or producing from both wells.

The wells will be cased and perforated as a preferred completion prior to fracturing operations. In some circumstances open hole completions may be utilized as an alternative. In cased completions, any perforating pattern may be used. In a preferred embodiment, perforations of at least two shots or more per foot of interval will be used with 90° phasing between alternate shots with the perforations aligned with the anticipated directions of the various fractures to be propagated.

In an alternative method, perforations in well number 2 may be initially aligned and shot in the anticipated directions of fractures 7 and 11, thus enhancing initiation of the fractures in their desired directions. Subsequent to the generation of fracture 7 and prior to operations for generating fracture 11, well number 2 is further perforated in the anticipated direction of fracture 11.

Having described specific embodiments of the instant invention, it will be understood that further modifications thereof may be suggested to those skilled in the art, and it is intended to cover all such modifications as fall within the scope of the appended claims.

What is claimed is:

1. A method of fracturing a subterranean formation comprising:

(a) providing a first well that extends from the surface of the earth and is completed to communicate with said formation;

(b) providing a second well that is spaced horizontally apart from said first well, said second well being completed to communicate with said formation;

(c) applying fluid pressure in said first well sufficient to initiate and propagate a first vertical fracture from said first well into said formation from said first well;

(d) subsequent to step (c) maintaining said fluid pressure in said first well at a pressure that will mitigate the propagation of said vertical fracture from said first well;

(e) applying fluid pressure in said second well sufficient to initiate and propagate a second vertical fracture into said formation from said second well in a direction away from and transverse to said first fracture;

(f) shutting-in said first well and allowing the fluid pressure therein to lessen;

(g) continuing to apply fluid pressure in said second well sufficient to initiate and propagate a third fracture from said second well to communicate with said first well;

(h) shutting in said second well for a time period sufficiently long to allow the in-situ pressures in the formation to equilibrate;

(i) flowing back fluids from said formation through said fractures and into said wells to clean said fractures;

(j) shutting in said first well; and (k) applying fluid pressure in said second well sufficient to initiate and propagate a fourth fracture from said second well which fracture is propagated into said formation in a direction essentially parallel to said first fracture formed from said first well.

2. The method of claim 1 wherein in step (d) said fluid pressure in said first well is reduced slightly and maintained at a pressure sufficiently low as to mitigate the propagation of said vertical fracture from said first well.

3. The method of claim 1 wherein said first and said second wells are cased and wherein said casing is perforated adjacent said subterranean formation.

4. The method of claim 3 wherein said perforations in said second well are aligned in a direction essentially parallel to the preferred fracture orientation of said subterranean formation.

5. A method of producing hydrocarbons from a hydrocarbonbearing formation comprising:

(a) providing a first well that extends from the surface of the earth and is completed to communicate with said formation;

(b) providing a second well that is spaced horizontally apart from said first well, said second well being completed to communicate with said formation;

(c) applying fluid pressures in said first well sufficient to initiate and propagate a first vertical fracture from said first well into said formation from said first well;

(d) subsequent to step (c) maintaining said fluid pressure in said first well at a pressure that will mitigate the propagation of said vertical fracture from said first well;

(e) applying fluid pressure in said second well sufficient to initiate and propagate a second vertical fracture into said formation from said second well in a direction away from and transverse to said first fracture;

(f) shutting-in said first well and allowing the fluid pressure therein to lessen; and (g) continuing to apply fluid pressure in said second well sufficient to initiate and propagate a third fracture from said second well to communicate with said first fracture;

(h) shutting-in said second well for a time period sufficiently long to allow the in-situ pressures in the formation to equilibrate;

(i) flowing back fluids from said formation through said fractures and into said wells to clean said fractures;

(j) shutting-in said first well;

(k) applying fluid pressure in said second well sufficient to initiate and propagate a fourth fracture from said second well which fracture is propagated into said formation in a direction essential parallel to said first fracture formed from said first well, (l) opening for production said second well and producing hydrocarbons from said hydrocarbon bearing formation via said first, second, third and fourth fractures.

6. The method of claim 5 wherein in step (d) said fluid pressure in said first well is reduced slightly and maintained at a pressure sufficiently low as to mitigate the propagation of said vertical fracture from said first well.

7. A method of producing hydrocarbons from a hydrocarbon bearing formation comprising:

(a) providing a first well that extends from the surface of the earth and is completed to communicate with said formation;

(b) providing a second well that is paced horizontally apart from said first well said second well being completed to communicate with said formation;

(c) applying fluid pressures in said first well sufficient to initiate and propagate a first vertical fracture from said first well into said formation from said first well;

(d) subsequent to step (c) maintaining said fluid pressure in said first well at a pressure that mitigate the propagation of said vertical fracture from said first well;

(e) applying fluid pressure in said second well sufficient to initiate and propagate a second vertical fracture into said formation from said second well in a direction away from and transverse to said first fracture;

(f) shutting-in said first well and allowing the fluid pressure therein to lessen; and (g) continuing to apply fluid pressure in said second well sufficient to initiate and propagate a third fracture from said second well to communicate with said first fracture;

(h) shutting-in said second well for a time period sufficiently long to allow the in-situ pressures in the formation to equilibrate;

(i) flowing back fluids from said formation through said fractures and into said wells to clean said fractures;

(j) shutting-in said first well;

(k) applying fluid pressure in said second well sufficient to initiate and propagate a fourth fracture from said second well which fracture is propagated into said formation in a direction essential parallel to said first fracture formed from said first well, (l) shutting-in said second well; and (m) opening for production said first well and producing hydrocarbons from said hydrocarbon bearing formation via said first, second, third and fourth fractures.

8. The method of claim 7 wherein in step (l) no well is shut in and in step (m) said first and said second wells are opened for production.

9. The method of claim 7 wherein wherein said first and said second wells are cased and wherein said casing is perforated adjacent said subterranean formation.

10. The method of claim 9 wherein said perforations in said second well are aligned in a direction essentially parallel to the preferred fracture orientation of said subterranean formation.

* * * * *